US005176083A

United States Patent [19]

Bullock

[11] Patent Number: 5,176,083

[45] Date of Patent: Jan. 5, 1993

[54] RAILROAD CAR TRUCK DAMPING MEMBER WITH OPEN CAVITY AND SUPPORT RIB CONSTRUCTION

[75] Inventor: Robert L. Bullock, Antioch, Ill.

[73] Assignee: Standard Car Truck Company, Park Ridge, Ill.

[21] Appl. No.: 689,492

[22] Filed: Apr. 23, 1991

[51] Int. Cl.[5] ..... B61F 5/50

[52] U.S. Cl. ..... 105/198.2

[58] Field of Search ..... 105/198.2, 198.4, 198.5; 188/381; 267/3, 134, 137, 196

[56] References Cited

U.S. PATENT DOCUMENTS

| | | | |
|---|---|---|---|
| 2,395,317 | 2/1946 | Cottrell | 105/198.4 |
| 3,218,990 | 11/1965 | Weber | 105/198.2 X |
| 4,256,041 | 3/1981 | Kempe et al. | 105/198.4 |
| 4,276,833 | 7/1981 | Bullock | 105/198.5 |
| 4,574,708 | 3/1986 | Solomon | 105/198.2 X |
| 4,915,031 | 4/1990 | Wiebe | 105/198.2 |

*Primary Examiner*—Robert J. Oberleitner
*Assistant Examiner*—Joseph Morano
*Attorney, Agent, or Firm*—Kinzer, Plyer, Dorn, McEachran and Jambor

[57] ABSTRACT

A friction casting for use in a railroad car truck between a side frame column and a bolster pocket slanted wall has a slanted wall to face and be in contact with the bolster pocket slanted wall and a vertical face in contact with the side frame column. The friction casting has a hollow interior, except for a support rib which is perpendicular to the slanted wall of the casting and supports the slanted wall of the casting generally at the zone of contact with the bolster pocket slanted wall. The support rib transfers the load from the slanted face of the friction casting to the vertical face of the friction casting generally at the center of pressure thereof.

7 Claims, 1 Drawing Sheet

Fig. 1.
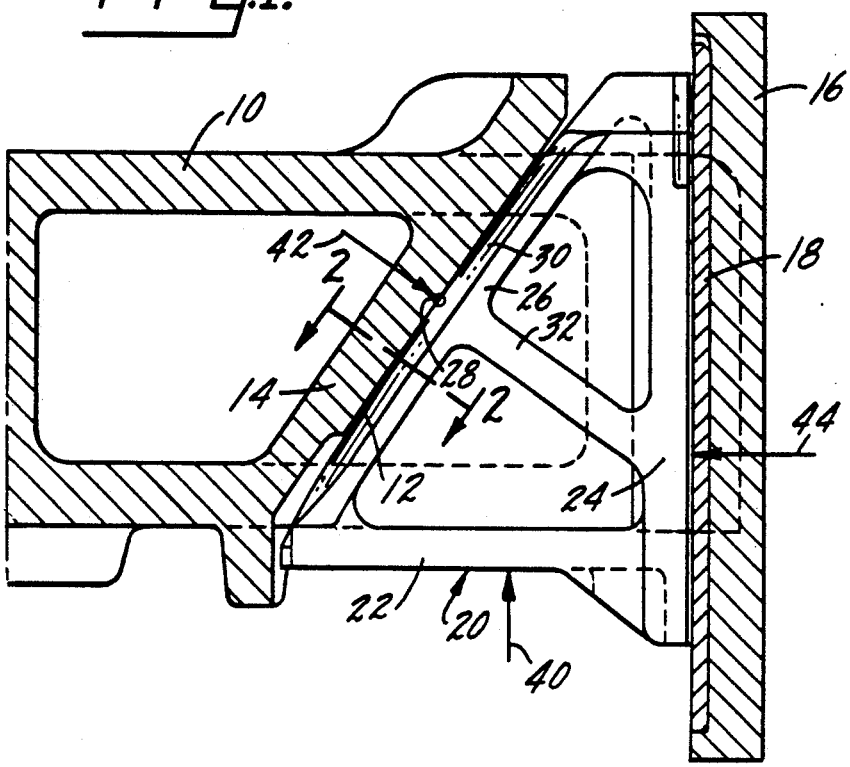
Fig. 2.
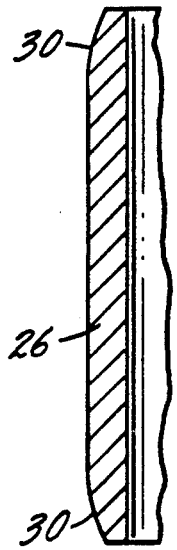
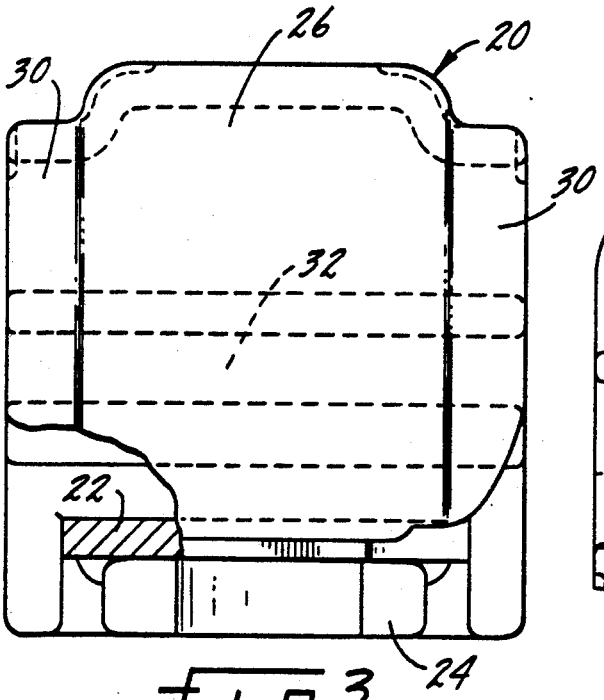
Fig. 3.
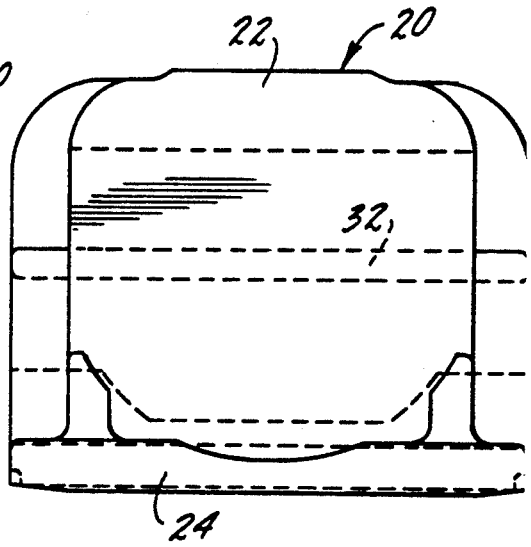
Fig. 4.

RAILROAD CAR TRUCK DAMPING MEMBER WITH OPEN CAVITY AND SUPPORT RIB CONSTRUCTION

FIELD OF THE INVENTION

The present invention relates to railroad car trucks, which are often termed bogies, and specifically to the damping system for such devices which is required for dynamic stability and to limit a phenomenon known as rock and roll of the railroad car and which is normally caused by the track rail joint being lower than adjoining portions of the rails. It is customary in car truck damping systems to utilize what is termed in the art as a friction wedge or friction casting which is located between the bolster and the side frame of the truck. In a commonly-used truck design the bolster has pockets which face the side frame columns and there are friction castings positioned in these pockets to restrain movement between the bolster and the side frame. The bolster pocket in a conventionally-used damping system has a rear slanted wall which contacts the slanted wall of the friction casting and the side frame column has a vertical wall which is in contact with the vertical wall of the friction casting. The friction casting is conventionally supported on one or more springs which seat on the side frame.

The present invention is specifically directed to a friction casting which is lighter in weight than prior art friction castings, thus providing a cost saving and a friction casting which is stronger, thus providing greater stability and resistance to rock and roll in today's heavy freight cars.

DESCRIPTION OF THE RELATED ART

U.S. Pat. No. 4,276,833, assigned to the assignee of the present application, discloses a friction casting of the same general type as disclosed herein. This patent is directed to a configuration of friction casting which is designed to reduce wear on the bolster pocket. U.S. Pat. No. 4,166,756, also assigned to the assignee of the present application, is directed to a specific metallurgy for use in a friction casting of the type described herein. The present invention may utilize such metallurgy, although the invention should not be limited thereto. The disclosures of the above patents are incorporated by reference herein.

SUMMARY OF THE INVENTION

The present invention is specifically directed to an improved friction casting which has been reduced in weight from prior art structures, but is materially stronger because of an interior support member.

A primary purpose of the present invention is to provide a friction casting for the use described in which the interior of the casting is generally hollow and there is a support rib positioned to support the zone of contact of the casting slanted wall and to transfer the load thereon to the center of pressure of the casting vertical wall.

Another purpose is a friction casting of the type described which fully complies with all AAR specifications, but which is less expensive to manufacture than prior art friction castings.

Other purposes will appear in the ensuing specification, drawings and claims.

BRIEF DESCRIPTION OF THE DRAWINGS

The invention is illustrated diagrammatically in the following drawings wherein:

FIG. 1 is a vertical section through a portion of a car truck bolster and side frame, showing the friction casting in position thereto, FIG. 2 is a section along plane 2—2 of FIG. 1, FIG. 3 is a front view, taken from the left side of FIG. 1, of the slanted wall of the friction casting, and FIG. 4 is a bottom view of the friction casting.

DESCRIPTION OF THE PREFERRED EMBODIMENT

A friction casting is positioned between the bolster and side frame of a car truck to dampen the relative movement therebetween and principally to improve stability and limit or eliminate the phenomenon commonly known as rock and roll, which is undesirable movement of a freight car caused by low rail joints. The friction casting is an element which will wear with time and so is generally replaced after a predetermined number of miles of service. In prior art friction castings of the type sold by the assignee of the present application, and commonly referred to in the trade as the "Barber" truck, the friction casting is biased to a position between the bolster and side frame by a special spring which seats upon the bottom part of the side frame window. Because such springs are special order, they are more expensive than the commonly-used standard AAR load springs which support the bolster within the side frame window. The present invention eliminates the need for special springs and the springs supporting each of the friction castings may be commonly-used standard AAR load springs having the same outside diameter as the springs used to support the bolster on the side frame.

In addition to changing the friction casting configuration so that it can be supported on a standard AAR type of spring, the friction casting has been widened from that conventionally used. Specifically, common friction castings of the type disclosed in the above-referenced patents, and for use in the 100-ton freight car merket, have a width of 6½". The present friction casting may have a width of 7" which tends to provide increased stability to the freight car.

The present invention can provide a reduced cost friction casting, and yet one having greater strength, due to the unique hollow interior of the casting which has a single support rib located to transfer the load on the slanted wall of the friction casting directly to the center of pressure of the casting wall facing the side frame column wear plate.

In the drawings, a portion of a car truck bolster is indicated at 10 and the bolster has a pocket 12, the rear of which is formed by a slanted wall 14. The side frame is represented in the drawings by the side frame column 16 which has a wear plate 18 facing the friction casting.

The friction casting is indicated generally at 20 and is shown positioned within the bolster pocket 12. The friction casting includes a bottom 22, which is solid and which will be supported by a conventional AAR spring having the same outside diameter as the springs of the type used to support bolster 10 within the side frame. There is a vertical wall 24 which faces and is in contact with the side frame column wear plate 18. The friction casting has a slanted wall 26 which faces and is in contact with the slanted wall 14 of the bolster pocket.

The slanted wall 26 of the friction casting has a given curvature from top to bottom, which is illustrated in the vertical section of FIG. 1. There is what may be termed a zone of contact 28 at the location where the sloping pocket surface becomes tangent to the given curvature of the casting wall 26. This zone is generally at the center of the friction casting slanted wall 26. When the friction casting is newly installed, the zone of contact may be quite small, even approaching line contact, since the wall 26 of the friction casting has a true curvature. As the casting is worn through use, the zone of contact will gradually widen. However, the generally dome-shaped curvature of the friction casting slanted wall will remain, except for the zone of contact which may tend to flatten through use. As illustrated in FIG. 2, the slanted wall 26 of the friction casting also has a slight curvature 30 at the opposite sides thereof.

The interior of friction casting 20 is generally open or hollow and the only element within the hollow interior is an integral reinforcing rib 32 which is generally perpendicular to slanted wall 26 of the friction casting and is located directly behind the zone of contact 28. Thus, the bolster load on the friction casting, which is on the zone of contact, will be directly transferred to the reinforcing rib 32 which is generally perpendicular to the slanted wall 26 of the friction casting. Rib 32 integrally joins vertical wall 24 at what may be termed the center of pressure of the friction casting vertical wall.

The static and dynamic forces on the friction casting during use may be represented by a plurality of vectors as shown in FIG. 1. There is an upward force 40 on the bottom of the casting from the spring which supports the casting. There is a force 42 on the casting from the bolster which will be generally normal to the slanted wall 26 and which will have both vertical and horizontal components. There is also a horizontal force 44 on the casting from the side frame column 16. The center of pressure or the center of applied force on the vertical wall of the friction casting is generally that point at which the counterclockwise and clockwise forces tending to turn the casting about the zone of contact within the bolster pocket equalize or balance. The force applied to the friction casting from the bolster will be at the zone of contact and this force will be supported by rib 32 and transferred through the rib to the center of pressure on the vertical face of the friction casting. Accordingly, the load applied to the friction casting from the bolster will be directly transferred to the center of pressure of the vertical wall of the casting. This substantially increases the strength of the friction casting and permits the casting to meet the higher forces required by the AAR performance specifications.

The location of rib 32 is dictated by the following considerations. The sloping surface of the friction casting is curved from top to bottom. The zone of contact between the friction casting and the bolster pocket slanted wall occurs at the location of tangency between these surfaces. Since the friction casting is in static equilibrium, the moments about the zone of contact must balance out to zero. This results in the center of pressure or force on the friction casting vertical wall reacting at a location below the zone of contact and above the bottom of the casting. Thus, the most efficient structure for a friction casting, and one which uses less material than a solid casting, is a friction casting which has a rib connected to the zone of contact and the zone of pressure. With these elements in combination, there is a substantial increase in efficiency and a reduction in cost over castings of the prior art.

The friction casting disclosed herein provides increased strength and reduced cost over prior art devices and does so by a combination of certain specified design criteria. The slanted face of the friction casting must have a slight curvature, the interior of the casting is hollow except for a support rib which supports the slanted wall of the casting generally at the zone of contact, and the load is transferred by the support rib to generally the center of pressure of the casting vertical wall.

The embodiments of the invention in which an exclusive property or privilege is claimed are defined as follows:

1. A friction casting for use in a railroad car truck between a side frame column and a bolster pocket slanted wall, the friction casting including a slanted wall adapted to face and be in contact with the bolster pocket slanted wall, said casting slanted wall, when viewed in vertical cross section, having a curvature providing a generally centrally located zone of contact with the bolster pocket slanted wall, said friction casting having a bottom wall formed and adapted to seat upon a supporting spring, said friction casting having a generally vertical wall formed and adapted to be in contact with a generally vertical wall of the side frame column, and said friction casting slanted wall, vertical wall, and bottom wall defining a generally open interior, a support rib in said casting generally open interior, said support rib being joined to said casting slanted wall at the slanted wall zone of contact and being generally perpendicular to said casting slanted wall, said support rib extending to and being joined with said casting vertical wall whereby said support rib supports said casting slanted wall at the zone of contact and transfers the load from the casting slanted wall zone of contact to the casting vertical wall.

2. The friction casting of claim 1 further characterized in that said friction casting rib terminates generally at the center of pressure of said casting vertical wall.

3. The friction asting of claim 1 further characterized in taht said rib extends generally the width of said casting slanted wall.

4. The friction casting of claim 1 further characterized in that said friction casting bottom wall is solid, without openings therein.

5. The friction casting of claim 1 further characterized in that said zone of contact, when the casting is newly installed, approaches line contact with the slanted wall of the bolster pocket, with the zone of contact gradually increasing as the casting is worn through use.

6. The friction casting of claim 1 further characterized in that said rib is integral with the casting slanted wall and casting vertical wall.

7. The friction casting of claim 1 further characterized in that said friction casting has a width of approximately 7 inches.

* * * * *